US006401988B1

(12) United States Patent
Parent et al.

(10) Patent No.: US 6,401,988 B1
(45) Date of Patent: Jun. 11, 2002

(54) RETROFIT FRICTION PAD FOR FLUID MATERIAL DISPENSER

(76) Inventors: Rodger G. Parent, 1252 Oakview Ave., Clearwater, FL (US) 34616; Robert Fuller, 1499 E. Normandy Blvd., Deltona, FL (US) 32725

( * ) Notice: Subject to any disclaimer, the term of this patent is extended or adjusted under 35 U.S.C. 154(b) by 0 days.

(21) Appl. No.: 09/968,250

(22) Filed: Oct. 1, 2001

(51) Int. Cl.[7] ..... B65D 88/54
(52) U.S. Cl. ..... 222/326; 222/327; 222/391
(58) Field of Search ..... 222/325–327, 222/391

(56) References Cited

U.S. PATENT DOCUMENTS 4,706,853 A * 11/1987 Stonesifer et al. ..... 222/391

6,234,348 B1 * 5/2001 Okamura et al. ..... 222/327

* cited by examiner

*Primary Examiner*—Philippe Derakshani
(74) *Attorney, Agent, or Firm*—Pendorf & Cutliff

(57) ABSTRACT

A friction pad to be used in conjunction with a cartridge in a caulking (or any cartridge type) dispenser. The invention contemplates using the friction pad in conjunction with an existing caulking dispenser to prevent the rotation of the cartridge by simply placing the friction pad in the front end of the dispenser. In its most basic embodiment, the present invention contemplates a friction pad adapted to be fitted between a front face of a cartridge type dispenser and a cartridge to prevent rotation of the cartridge, the friction pad comprises: a front face adapted to be fitted in engagement with front end of the dispenser; and a back face adapted to be fitted in engagement with the cartridge.

20 Claims, 3 Drawing Sheets

RETROFIT FRICTION PAD FOR FLUID MATERIAL DISPENSER

FIELD OF THE INVENTION

The present invention concerns a friction pad to be used in conjunction with a cartridge in any cartridge type dispenser, preferably a caulking gun type dispenser. More specifically, the invention concerns a friction pad that can be used with any existing caulking dispenser to prevent the rotation of the cartridge.

BACKGROUND OF THE INVENTION

Fluid dispensers, such as caulking guns, find widespread use in industrial and household applications. They are used with standardized cartridges or "tubes." The cartridges are typically provided in the form of tubes having a dispensing outlet (a conical tip or nozzle for example) disposed on one end, with the other end adapted for receiving a plunger mechanism or the like from the dispenser. Inside the cartridge's plunger receiving end is a slidably sealed, axially-movable disc.

The cartridges may contain a wide variety of viscous substances, such as caulking material, waterproofing adhesives, lubricants and sealants, which may be useful in construction for bonding materials together, or in the home for filling in cracks of a window frame and joints of a pipe to prevent leakage.

The typical caulking dispenser is a cradle with a stop on one end and a plunger in the other. The half-tube includes a handle and trigger extending from the handle that forcibly drives the plunger along the tube. The cartridge containing caulking is inserted into the dispenser. A nozzle, integral with the cartridge, extends through a passage in the stop; the plunger inserts into the cartridge for extruding caulking through the nozzle when the plunger drives a plunger into the cartridge.

The standard cartridges and caulking dispensers that load them are successful because of their ability to dispense the material directly into a corner, groove, or crack without mess or spread of material.

It is a common practice to cut the plastic tip of the dispensing nozzle at a predetermined angle. The tip is cut in an angle because 1) it is hard to apply the fluid material if the dispenser is perpendicular to the surface; 2) the amount of material dispensed when the tip is not cut in an angle is less than an angled tip; 3) the fluid material flushes easier; and 4) it is easier to handle the dispenser in corners.

The dispensing nozzle is then moved as desired relative to the working surface, and the caulking is expelled. The angled cut provides a ready means of applying the caulking directly into the crack or onto the surface intended while the outwardly projecting top shaped by the angle smoothes the surface of the caulking. For this procedure to work properly, the angle of the cut must be moved with the direction of movement of the dispenser.

One serious drawback with the existing caulking dispensers is that it is well known that the cartridge is prone to rotate within the cradle, which holds the cartridge. This rotation causes the caulking to exit the dispensing nozzle to one side or the other of the intended point of application. When this happens, the caulking must either be removed or applied again after the dispensing nozzle has been correctly positioned or by moving the bead of caulking into its proper position by the finger. In either case, both time and materials are wasted.

U.S. Pat. No. 4,706,853 entitled "Caulking Dispenser with Means to Prevent Rotation of Compound Cartridge During Use and to Provide Positive Pressure Release" to Stonesifer et al. discloses a caulking dispenser that addresses this problem. The reference avoids the rotation of the cartridge by having a caulking dispenser that includes a pair of extending prongs integrally fixed to the plunger. The prongs penetrate the contact surface disk of the cartridge.

While the Stonessifer et al. device provides satisfactory service, the manufacture of the dispenser is not optimum because it requires special complex designed parts, which will include additional cost.

Another problem presented by the Stonessifer et al. device is that most of the consumers already own a caulking dispenser, and in order to avoid the rotation of the cartridge, it will be necessary for them to buy a new dispenser.

Accordingly, the present inventor felt a need for a simplified, economical, reliable, and easy-to-use device that can prevent the rotation of the cartridge in a caulking dispenser.

There is also a need in the art for a device that is adapted to be removably mounted to a conventional caulking dispenser to prevent the rotation of the cartridge.

SUMMARY OF THE INVENTION

A prime object of the invention is to provide means for preventing rotation of a cartridge in a caulking dispenser that is of low cost, easy to use, and flexible.

It is yet another object of the present invention to provide a rotation preventing means for a caulking dispenser that is adapted to be removably mounted to a conventional existing caulking dispenser.

It is yet another object of the invention to provide means for preventing rotation of a cartridge in a caulking dispenser in order to maintain the angle of movement of an angularly cut dispensing nozzle.

It is yet another object of the invention to provide such means made up of materials that are reusable, and recyclable, and in long range may be considered degradable.

It is yet another object of the invention to provide a simple and highly efficient means for use on reciprocating plungers.

After years of working with caulking dispensers and experiencing the inconvenience of keeping the tip of the cartridge aligned with the work surface because of the rotation of the cartridge, the present inventor conceived the simple idea of adding a friction pad at the front face of the gun to prevent the rotation of the cartridge.

The present invention is a very simple way of preventing the rotation of the cartridge on existing caulking dispensers.

More particularly, the present invention contemplates in its most basic embodiment a method for preventing the rotation of a cartridge in a cartridge type dispenser, wherein the dispenser includes a cradle having a front wall on a first end and a plunger in a second end, a handle, and a trigger extending from the handle, wherein the trigger drives the plunger along the cartridge, the method comprising the steps of:

a) inserting a friction pad to the cradle; and b) inserting the cartridge in the cradle;

wherein the friction pad is adapted to be fitted between the cradle and the cartridge, the friction pad comprising:

a front face adapted to be fitted in engagement with the cradle; and a back face adapted to be fitted in engagement with the cartridge.

The friction pad comprises a C-shape made of layers of a single friction material.

In a first preferred embodiment of the invention, a layer of an adhesive material is bonded to the back face of the friction pad.

In a second preferred embodiment of the invention, the friction pad comprises:

a first layer having a first face and a second face, the first face of the first layer adapted to be fitted in engagement to the cradle;

a second layer having a first face and a second face, first face of the second layer adapted to be fitted in engagement to the second face of the first layer;

a third layer having a first face and a second face, the first face of the third layer adapted to be fitted in engagement to the second face of the second layer, and the second face of the third layer adapted to be fitted in engagement to the cartridge.

In a third preferred embodiment, the friction pad is shaped as a ring. The ring includes layers of a single friction material or layers of different friction materials.

In a less preferred embodiment of the present invention, the friction pad is adapted to be fitted between the plunger and the cartridge to prevent the rotation of the cartridge.

The invention contemplates using the above friction pad in conjunction with an existing caulking dispenser to prevent the rotation of the cartridge by simply placing the friction pad between the cradle and the cartridge.

The foregoing has outlined rather broadly the more pertinent and important features of the present invention in order that the detailed description of the invention that follows may be better understood, and so that the present contribution to the art can be more fully appreciated. Additional features of the invention will be described hereinafter, which shape the subject of the claims of the invention. It should be appreciated by those skilled in the art that the conception and the specific embodiments disclosed may be readily utilized as a basis for modifying or designing other friction pads for caulking dispensers for carrying out the same purposes of the present invention. It should also be realized by those skilled in the art that such equivalent structures do not depart from the spirit and scope of the invention as set forth in the appended claims.

BRIEF DESCRIPTION OF THE DRAWINGS

In order to facilitate an understanding of the invention, the invention will be discussed with reference to the drawings, wherein there is shown.

DETAILED DESCRIPTION OF THE INVENTION

The present invention is directed to a friction pad which may be constructed according to a great variety of different conventional designs, and which may be used with a variety of conventional existing caulking dispensers.

The term "caulk" is used throughout the application, but it will be readily understood that the invention is not limited to any one particular material, and that the material being dispensed may be selected from a wide variety of materials such as sealants and adhesives, viscous grinding compounds and lubricating materials, paints, colors and colorants, and even food materials.

The present invention concerns a method for preventing the rotation of a cartridge in a cartridge type dispenser, wherein the dispenser includes a cradle having a front wall on a first end and a plunger in a second end, a handle, and a trigger extending from the handle, wherein the trigger drives the plunger along the cartridge, the method comprising the steps of:

inserting a friction pad to the cradle; and inserting the cartridge in the cradle;

wherein the friction pad is adapted to be fitted between the cradle and the cartridge, the friction pad comprising:

a front face adapted to be fitted in engagement with the cradle; and a back face adapted to be fitted in engagement with the cartridge.

Figure 1:
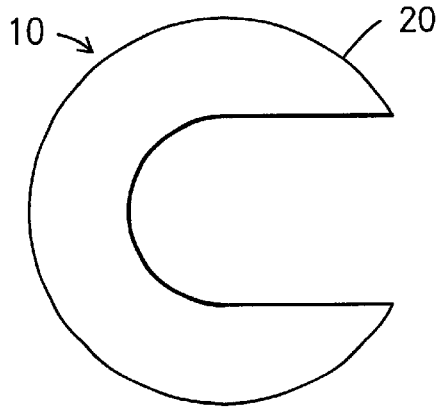
FIG. 1 is a front view of the basic shape of the friction pad of the invention.
Figure 2:
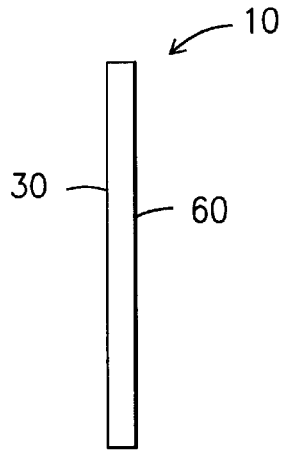
FIG. 2 is a perspective side view of the friction pad of FIG. 1.
Figure 3:
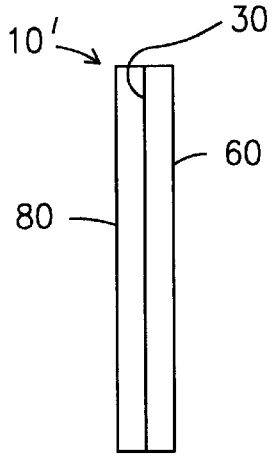
FIG. 3 is a side view of the first preferred embodiment of the present invention.
Figure 4:
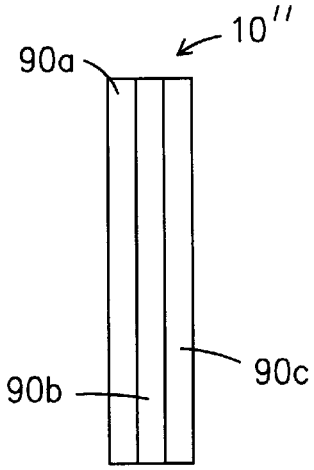
FIG. 4 is a side view of the second preferred embodiment of the present invention.
Figure 6:
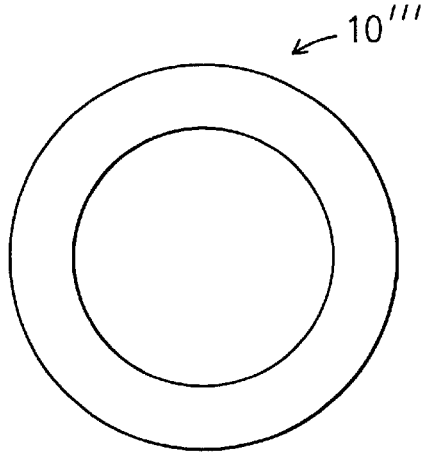
FIG. 6 is a front side view of the third preferred embodiment of the present invention.

Referring to the friction pad generically, attention is directed to FIGS. 1 and 2 where the friction pad is shown in its basic shape.

The friction pad 10 of the present invention in its most basic shape comprises a C-shape made of layers of a single friction material 20. The pad includes an inner face 30 connected to the cradle of the dispenser and an outer face 60 connected to a cartridge 70.

The size of the friction pad may be of any size or shape, which is practical and useful. A very common size of the friction pad is from about 5 to about 1.0 inches in diameter, preferably 4 to 2 inches in diameter. The pad may be of other sizes instead, if desired, and there is no limit from a practical standpoint as to the shape of the pad. For example, the pad may be oval, square, rectangular, round, triangular, or any other shape.

The thickness of the friction pad is set to be between 0.1 to 0.5 inches, preferably 0.25 inches. The thickness of the pad depends on the character and thickness of all the layers making up the pad.

The friction material can be selected from a friction material of the group consisting of polyurethane foam, rubber, synthetic resin foams such as polyurethane foam; synthetic resin sponges; plastics such as acrylic resin, vinyl chloride resin and polypropylene; metals such as iron and aluminum, ceramic ware such as ceramics and glass, and natural materials such as leather and wood.

In a first preferred embodiment of the invention, a layer of an adhesive material 80 is connected to the inner face 30 of the friction pad 10'.

In a second preferred embodiment of the invention, the pad 10" includes layers of more than one friction material 90*a*, 90*b*, 90*c*, etc.

For example, the pad may have three contiguous layers of polymeric materials of distinct properties, said layers comprising:

a. a first layer 90*a*, which is adapted to be fitted in engagement to the cradle of the dispenser, is made up of a material that is relatively hard, non abrasive, but has a high gripping effect. This layer holds the pad in position, but prevents the pad from beeing moved, even against the high friction effect, and it does not scratch or otherwise impair the surface of the cradle of the dispenser. Example of such material is cork.

b. a second layer 90*b* having high force-dampening qualities and adapted to dampen shock force across said pad, and comprising a deflectable material such as rubber or foam.

c. a third layer 90*c* comprised of a relatively soft, high coefficient of friction material.

In a third preferred embodiment of the present invention, the pad is shaped as a ring 10'''. The ring includes layers of a single friction material, or layers of different friction materials. The ring also includes a layer of an adhesive material connected to the inner face of the friction pad.

In a less preferred embodiment, the invention contemplates using the above friction pad in conjunction with an existing caulking dispenser to prevent the rotation of the cartridge by simply placing the friction pad between the plunger and the cartridge. The pad includes an inner face 30 connected to a disk 40 of a plunger 50 and an outer face 60 connected to a cartridge 70. (FIG. 8)

EXAMPLE 1

Figure 5:
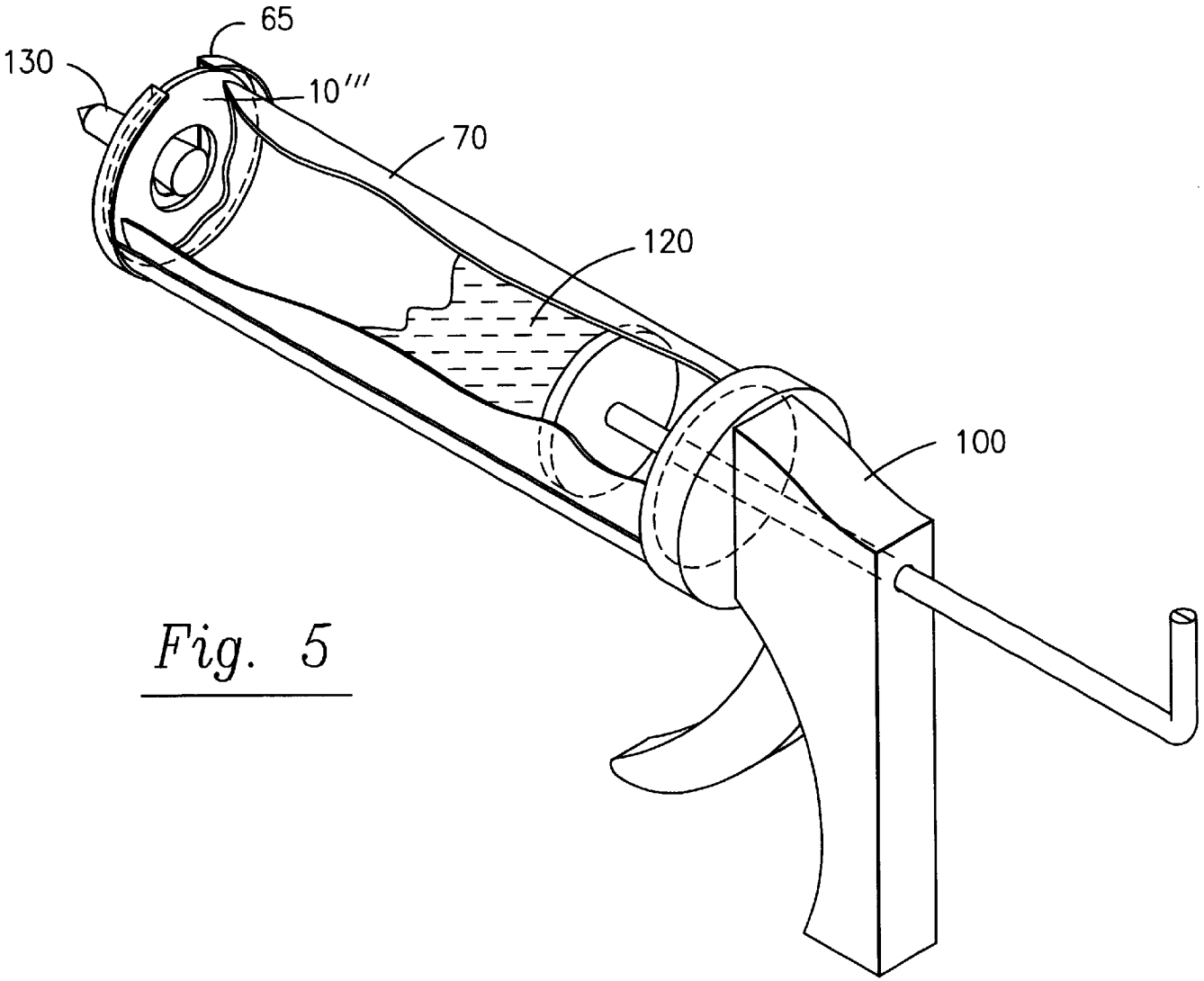
FIG. 5 is a perspective side view of a caulking dispenser including the friction pad of the present invention.

FIG. 5 shows a caulking dispenser 90 comprising a stock 100 and a cartridge holder or open structured supporting framework to be described. The cartridge holder supports a cartridge 70 having a cylindrical body 110 containing a viscous caulking material or compound 120. The first end of the cylindrical cartridge body 110 is provided with an extrusion nozzle 130 and a front face 65. The front face includes an inner face and an outer face. The second end of the cylindrical cartridge body encompasses a plunger 50, which is slidable along the tubular length of the caulk cartridge body.

The inner face of the front wall 65 on the front end of the dispenser is topped with a friction pad 10 to prevent the cartridge from rotating.

The operating mechanism for the caulking dispenser may be any of those conventionally employed in the prior art.

EXAMPLE 2 (LESS PREFERRED EMBODIMENT)

Figure 7:
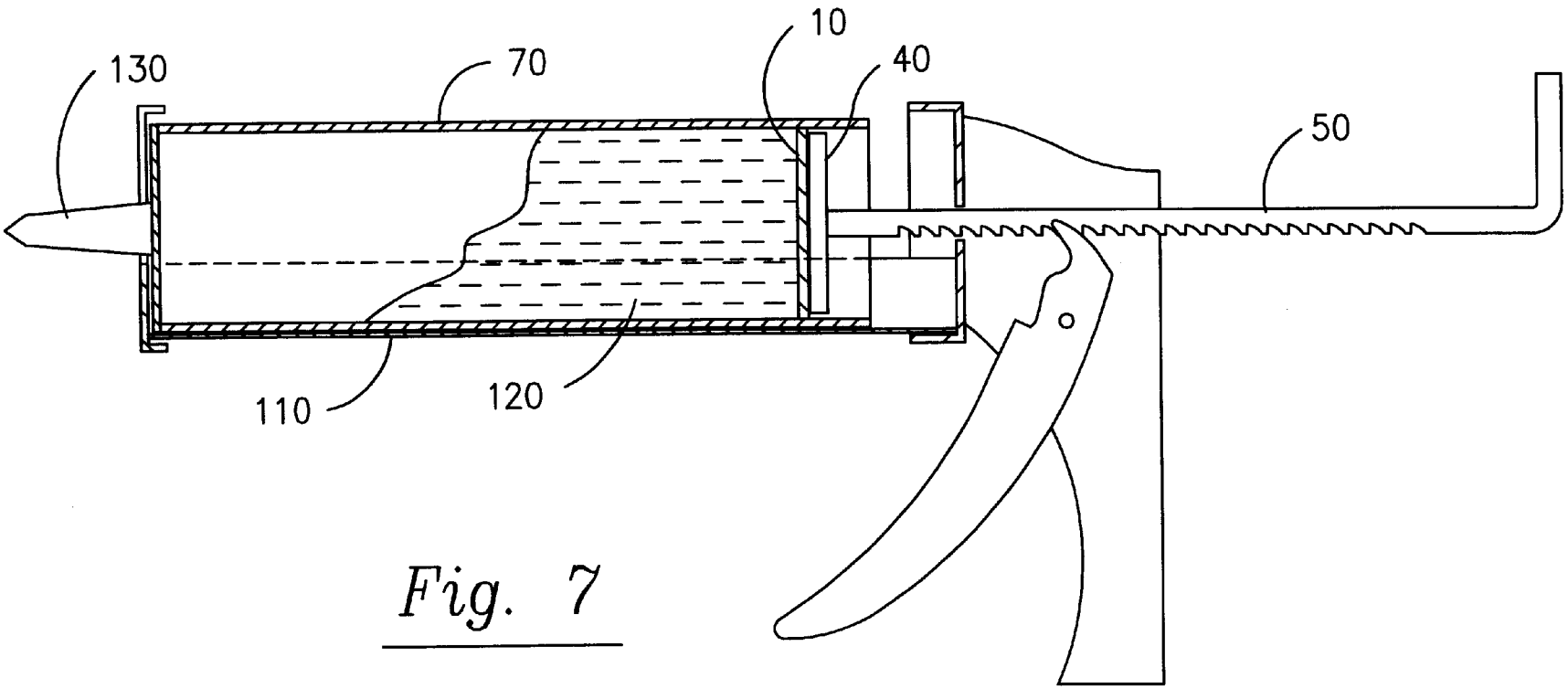
FIG. 7 is a front side view of the less preferred embodiment of the present invention.

FIG. 7 shows a caulking dispenser 90 comprising a stock 100 and a cartridge holder or open structured supporting framework to be described. The cartridge holder supports a cartridge 70 having a cylindrical body 110 containing a viscous caulking material or compound 120. One end of the cylindrical cartridge body 110 is provided with an extrusion nozzle 130. The other end of the cylindrical cartridge body encompasses a plunger 50, which is slidable along the tubular length of the caulk cartridge body. The plunger has a disk 40 connected to the forward end of the plunger.

The disk 40 on the plunger 50 is topped with a friction pad 10. The pad 10 bears on the plunger 50, which plugs the bottom of a cartridge. The friction pad prevents the cartridge from rotating.

The operating mechanism for the caulking dispenser may be any of those conventionally employed in the prior art.

The above examples are presented in order to illustrate the invention and are not intended to limit the invention in any way. Those working in the art would readily appreciate that substantial modifications within the scope of the invention may be made to the illustrative embodiments.

Although this invention has been described in its preferred shape with a certain degree of particularity with respect to the friction pad as shown in FIG. 1, it is understood that the present disclosure of the preferred shape has been made only by way of example, and that numerous changes in the details of structures and the composition of the system may be resorted to without departing from the spirit and scope of the invention.

What is claimed is:

1. A method for preventing the rotation of a cartridge in a cartridge type dispenser, wherein the dispenser includes a cradle having a front wall on a first end and a plunger in a second end, a handle, and a trigger extending from the handle, wherein the trigger drives the plunger along the cartridge, the method comprising the steps of:

a) inserting a friction pad to the cradle; and b) inserting the cartridge in the cradle;

wherein the friction pad is adapted to be fitted between the cradle and the cartridge, the friction pad comprising:

a front face adapted to be fitted in engagement with the cradle; and a back face adapted to be fitted in engagement with the cartridge.

2. A method according to claim 1, wherein the friction pad has C-shape.

3. A method according to claim 1, wherein the friction pad has a ring shape.

4. A method according to claim 1, wherein the pad is made of layers of different friction materials.

5. A method according to claim 1, wherein the pad further includes a layer of an adhesive material connected to the front face of the friction pad.

6. A method according to claim 3, wherein the pad is made of layers of different friction materials.

7. A method according to claim 1, wherein the pad comprises:

a. a first layer having a first face and a second face, the first face of the first layer adapted to be fitted in engagement to the cradle;

b. a second layer having a first face and a second face, first face of the second layer adapted to be fitted in engagement to the second face of the first layer;

c. a third layer having a first face and a second face, the first face of the third layer adapted to be fitted in engagement to the second face of the second layer, and the second face of the third layer adapted to be fitted in engagement to the cartridge.

8. A method according to claim 1, wherein the front wall includes an inner face and an outer face, wherein the friction pad is placed in the inner face of the front wall.

9. A method according to claim 1, wherein the cartridge is filled with a material selected from the group consisting of sealants, adhesives, viscous grinding compounds, lubricating materials, paints, colors and colorants, and food materials.

10. A method according to claim 1, wherein the friction material can be selected from the group consisting of polyurethane foam, synthetic resin foams such as polyurethane foam; synthetic resin sponges; plastics such as acrylic resin, vinyl chloride resin and polypropylene; metals such as iron and aluminum, ceramic ware such as ceramics and glass, and natural materials such as leather and wood.

11. A cartridge type dispenser comprising:

a cradle having a front wall on a first end and a plunger in a second end;

a handle;

a trigger extending from the handle, wherein the trigger drives the plunger along the cartridge; and a friction pad adapted to be fitted between the cradle and the cartridge, the friction pad comprising:

a front face adapted to be fitted in engagement with the cradle; and a back face adapted to be fitted in engagement with the cartridge.

12. A dispenser according to claim 11, wherein the friction pad has a C-shape.

13. A method according to claim 11, wherein the friction pad has a ring shape.

14. A method according to claim 11, wherein the pad is made of layers of different friction materials.

15. A method according to claim 11, wherein the pad further includes a layer of an adhesive material connected to the front face of the friction pad.

16. A method according to claim 13, wherein the pad is made of layers of different friction materials.

17. A method according to claim 11, wherein the pad comprises:

a. a first layer having a first face and a second face, the first face of the first layer adapted to be fitted in engagement to the cradle;

b. a second layer having a first face and a second face, first face of the second layer adapted to be fitted in engagement to the second face of the first layer;

c. a third layer having a first face and a second face, the first face of the third layer adapted to be fitted in engagement to the second face of the second layer, and the second face of the third layer adapted to be fitted in engagement to the cartridge.

18. A method according to claim 11, wherein the front wall includes an inner face and an outer face, wherein the friction pad is placed in the inner face of the front wall.

19. A method according to claim 11, wherein the cartridge is filled with a material selected from the group consisting of sealants, adhesives, viscous grinding compounds, lubricating materials, paints, colors and colorants, and food materials.

20. A method according to claim 11, wherein the friction material can be selected from the group consisting of polyurethane foam, synthetic resin foams such as polyurethane foam; synthetic resin sponges; plastics such as acrylic resin, vinyl chloride resin and polypropylene; metals such as iron and aluminum, ceramic ware such as ceramics and glass, and natural materials such as leather and wood.

* * * * *